US008215387B1

(12) United States Patent
Weiers et al.

(10) Patent No.: US 8,215,387 B1
(45) **Date of Patent: *Jul. 10, 2012**

(54) IN SITU COMBUSTION IN GAS OVER BITUMEN FORMATIONS

(75) Inventors: Larry Weiers, Calgary (CA); Ben Nzekwu, Calgary (CA)

(73) Assignee: Encana Corporation, Calgary, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/427,067

(22) Filed: Mar. 22, 2012

Related U.S. Application Data

(63) Continuation of application No. 13/042,227, filed on Mar. 7, 2011, now Pat. No. 8,167,040, which is a continuation of application No. 11/813,841, filed as application No. PCT/CA2006/000046 on Jan. 13, 2006, now Pat. No. 7,900,701.

(30) Foreign Application Priority Data

Jan. 13, 2005 (CA) ..... 2492308

(51) Int. Cl.
*E21B 43/243* (2006.01)
*E21B 49/00* (2006.01)

(52) U.S. Cl. ..... 166/251.1; 166/257; 166/258; 166/260; 166/261; 166/272.1; 166/272.3

(58) Field of Classification Search ..... 166/245, 166/251.1, 257, 258, 260, 261, 272.1, 272.3
See application file for complete search history.

(56) References Cited

U.S. PATENT DOCUMENTS

| | | | | | |
|---|---|---|---|---|---|
| 3,026,935 | A * | 3/1962 | Allen et al. | 166/256 |
| 3,026,937 | A * | 3/1962 | Simm | 166/260 |
| 3,032,102 | A * | 5/1962 | Parker | 166/250.15 |
| 3,072,187 | A * | 1/1963 | Carr | 166/258 |
| 3,072,191 | A * | 1/1963 | Bond et al. | 166/257 |
| 3,097,690 | A * | 7/1963 | Terwilliger et al. | 166/259 |
| 3,147,804 | A * | 9/1964 | Wyllie | 166/258 |
| 3,163,215 | A * | 12/1964 | Stratton | 166/257 |
| 3,193,008 | A * | 7/1965 | Moore | 166/258 |
| 3,205,944 | A * | 9/1965 | Walton | 166/401 |
| 3,208,519 | A * | 9/1965 | Moore | 166/261 |
| 3,349,846 | A * | 10/1967 | Trantham et al. | 166/257 |
| 3,434,541 | A * | 3/1969 | Cook et al. | 166/256 |
| 3,448,807 | A * | 6/1969 | Strickland, Jr. | 166/256 |
| 3,454,365 | A * | 7/1969 | Lumpkin et al. | 436/133 |
| 3,978,920 | A * | 9/1976 | Bandyopadhyay et al. | 166/258 |
| 4,040,483 | A * | 8/1977 | Offeringa | 166/401 |
| 4,252,191 | A * | 2/1981 | Pusch et al. | 166/261 |
| 4,393,936 | A * | 7/1983 | Josendal | 166/402 |
| 5,339,897 | A * | 8/1994 | Leaute | 166/245 |
| 7,900,701 | B2 * | 3/2011 | Weiers et al. | 166/251.1 |
| 8,167,040 | B2 * | 5/2012 | Weiers et al. | 166/251.1 |
| 2001/0049342 | A1 * | 12/2001 | Passey et al. | 507/200 |
| 2005/0167103 | A1 * | 8/2005 | Horner et al. | 166/268 |

* cited by examiner

*Primary Examiner* — George Suchfield
(74) *Attorney, Agent, or Firm* — Karl Bozicevic; Bozicevic, Field & Francis LLP

(57) ABSTRACT

The invention provides methods for natural gas and oil recovery, which include the use of air injection and in situ combustion in natural gas reservoirs to facilitate production of natural gas and heavy oil in gas over bitumen formations.

17 Claims, 19 Drawing Sheets

| | |
|---|---|
| SIMULATOR | CMG STARS |
| COMPONENTS | WATER, BITUMEN, $CO_2$, $CH_4$, CO/$N_2$, OXYGEN AND COKE |
| GRID SIZE | 8M X 8M X 1M ... FORMATION THICKNESS FROM 3 TO 10 M |
| | |
| WELLS | WABISKAW K3 POOL PLUS PROPERTIES UP TO K1 POOL |
| HETEROGENEITY | HOMOGENEOUS |
| PERMEABILITY | 0.2 TO 0.9 D (HORIZONTAL); 0.45D (VERT) |
| POROSITY | 23 TO 32% ... 26+% HEART OF POOL |
| FLUID SATURATIONS | MAPS FROM PETROPHYSICAL WORK |
| OIL | 20 TO 40% |
| GAS | 40 TO 60% |
| WATER | 20 TO 40% |
| TEMPERATURE | 12 TO 15 °C |
| GAS ANALYSIS | $N_2$ (0.44%); $CO_2$ (0.57%); $CH_4$ (98.98%) |
| INITIAL RESERVOIR PRESSURE | 2050 kPa |
| INJECTED AIR TEMP | 177 °C |
| | |

FIG. 17

| | |
|---|---|
| 2004 | MONITOR WELLS |
| 2004/05 | EUB APPLICATION AND APPROVAL |
| 2004/05 | ACQUIRE/CONSTRUCT FACILITIES AND EQUIPMENT |
| 2005 | GAS PRODUCTION |
| 2006 | REPRESSURE GAS POOLS |
| 2007 | PHASE 2 BITUMEN PRODUCTION |

FIG. 19

IN SITU COMBUSTION IN GAS OVER BITUMEN FORMATIONS

CROSS-REFERENCE TO RELATED APPLICATIONS

This application is a continuation of U.S. patent application Ser. No. 13/042,227 filed Mar. 7, 2011, which is a continuation of U.S. patent application Ser. No. 11/813,841, filed Jan. 11, 2008 (now issued U.S. Pat. No. 7,900,701), which application is a 371 National Phase of International Patent Application Serial No. CA2006/000046 filed Jan. 13, 2006, which application claims priority to Canadian patent application serial number 2,492,308 filed Jan. 13, 2005 which are herein incorporated by reference in their entirety.

FIELD OF THE INVENTION

The present invention relates generally to natural gas and oil recovery and particularly to air injection and in situ combustion in natural gas reservoirs to facilitate conservation of both resources through production of the natural gas resource and subsequent recovery of heavy oil from an underlying zone.

BACKGROUND OF THE INVENTION

In many circumstances, a cost-effective means of recovering natural gas from a reservoir is to produce the natural gas with consequent decline in reservoir pressure until an economic lower limit of productivity is reached. Frequently, when pressure in the natural gas reservoir decreases to a sufficiently low level, compression is instituted to improve productivity. At the low pressures often associated with the conclusion of such depletion operations, the molar quantity of natural gas still remaining in the reservoir is small and secondary recovery techniques for this residual quantity are not normally cost effective. In some reservoirs, natural gas zones are associated with underlying zones containing heavy oils. There are special difficulties associated with recovering heavy oils, and in some circumstances the depletion of gas zone overlying a heavy oil zone can interfere with subsequent efforts to recover the heavy oil.

A variety of processes are used to recover heavy oils and bitumen. Thermal techniques may be used to heat the reservoir to produce the heated, mobilised hydrocarbons from wells. One such technique for utilising a single horizontal well for injecting heated fluids and producing hydrocarbons is described in U.S. Pat. No. 4,116,275, which also describes some of the problems associated with the production of mobilised viscous hydrocarbons from horizontal wells.

One thermal method of recovering viscous hydrocarbons using two vertically spaced horizontal wells is known as steam-assisted gravity drainage (SAGD). Various embodiments of the SAGD process are described in Canadian Patent No. 1,304,287 and corresponding U.S. Pat. No. 4,344,485. In the SAGD process, steam is pumped through an upper, horizontal, injection well into a viscous hydrocarbon reservoir while hydrocarbons are produced from a lower, parallel, horizontal, production well vertically spaced proximate to the injection well. The injection and production wells are typically located close to the bottom of the hydrocarbon deposit.

It is believed that the SAGD process works as follows. The injected steam initially mobilises the in-place hydrocarbon to create a "steam chamber" in the reservoir around and above the horizontal injection well. The term "steam chamber" means the volume of the reservoir which is saturated with injected steam and from which mobilised oil has at least partially drained. As the steam chamber expands upwardly and laterally from the injection well, viscous hydrocarbons in the reservoir are heated and mobilised, especially at the margins of the steam chamber where the steam condenses and heats a layer of viscous hydrocarbons by thermal conduction. The mobilised hydrocarbons (and aqueous condensate) drain under the effects of gravity towards the bottom of the steam chamber, where the production well is located. The mobilised hydrocarbons are collected and produced from the production well. The rate of steam injection and the rate of hydrocarbon production may be modulated to control the growth of the steam chamber to ensure that the production well remains located at the bottom of the steam chamber in an appropriate position to collect mobilised hydrocarbons.

Alternative primary recovery processes may be used that employ thermal and non-thermal components to mobilise oil. For example, light hydrocarbons may be used to mobilise heavy oil. U.S. Pat. No. 5,407,009 teaches an exemplary technique of injecting a hydrocarbon solvent vapour, such as ethane, propane or butane, to mobilise hydrocarbons in the reservoir.

In the context of the present application, various terms are used in accordance with what is understood to be the ordinary meaning of those terms. For example, "petroleum" is a naturally occurring mixture consisting predominantly of hydrocarbons in the gaseous, liquid or solid phase. In the context of the present application, the words "petroleum" and "hydrocarbon" are used to refer to mixtures of widely varying composition. The production of petroleum from a reservoir necessarily involves the production of hydrocarbons, but is not limited to hydrocarbon production. Similarly, processes that produce hydrocarbons from a well will generally also produce petroleum fluids that are not hydrocarbons. In accordance with this usage, a process for producing petroleum or hydrocarbons is not necessarily a process that produces exclusively petroleum or hydrocarbons, respectively. "Fluids", such as petroleum fluids, include both liquids and gases. Natural gas is the portion of petroleum that exists either in the gaseous phase or is in solution in crude oil in natural underground reservoirs, and which is gaseous at atmospheric conditions of pressure and temperature. Natural Gas may include amounts of non-hydrocarbons.

It is common practice to segregate petroleum substances of high viscosity and density into two categories, "heavy oil" and "bitumen". For example, some sources define "heavy oil" as a petroleum that has a mass density of greater than about 900 kg/m3. Bitumen is sometimes described as that portion of petroleum that exists in the semi-solid or solid phase in natural deposits, with a mass density greater than about 1000 $kg/m^3$ and a viscosity greater than 10,000 centipoise (cP; or 10 Pa·s) measured at original temperature in the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

A reservoir is a subsurface formation containing one or more natural accumulations of moveable petroleum, which are generally confined by relatively impermeable rock. An "oil sand" or "tar sand" reservoir is generally comprised of strata of sand or sandstone containing petroleum. A "zone" in a reservoir is merely an arbitrarily defined volume of the reservoir, typically characterised by some distinctive property. Zones may exist in a reservoir within or across strata, and may extend into adjoining strata. In some cases, reservoirs containing zones having a preponderance of heavy oil are associated with zones containing a preponderance of natural gas. This "associated gas" is gas that is in pressure communication with the heavy oil within the reservoir, either directly or indirectly, for example through a connecting water zone.

A "chamber" within a reservoir or formation is a region that is in fluid communication with a particular well or wells, such as an injection or production well. For example, in a SAGD process, a steam chamber is the region of the reservoir in fluid communication with a steam injection well, which is also the region that is subject to depletion, primarily by gravity drainage, into a production well.

SUMMARY OF THE INVENTION

In one aspect, the invention provides methods for pressuring a natural gas zone that overlies a heavy oil zone, to facilitate subsequent recovery of heavy oil using techniques such as SAGD. In the context of the invention, pressuring of the gas zone encompasses process involving re-pressuring, such as re-pressuring of a depleted gas zone, or maintaining a selected pressure within the gas zone.

In various embodiments, the invention provides methods for pressuring a "gas over bitumen" reservoir. Such reservoirs may be made up of a natural gas zone, for example a gas zone that has been subject to depletion, in pressure communication with an underlying heavy oil zone, such as zone containing bitumen. The gas and oil zones may be in direct or indirect pressure communication, for example the gas zone and the heavy oil zone may be in pressure communication through a water zone. In a majority of heavy oil reservoirs with overlying gas cap, the heavy oil zone may for example have a heavy oil saturation of at least 50%. In general, there is continuum of oil saturation from a low value, in some instances as low as 5%, within the gas zone, to a high value within the heavy oil zone, in some instances as high as 85%. The methods of this invention may include the steps of injecting an oxidising gas, such as air, into the natural gas zone to initiate or sustain in situ combustion in the gas zone. The sustained in situ combustion may be managed so as to control the average reservoir pressure (i.e. which may for example include augmenting or elevating the pressure, to make the pressure higher than it would otherwise have been, which may for example have the net effect of maintaining the reservoir pressure at a desired level, or of allowing it to fall to a selected level that is nevertheless higher than it would otherwise have been in the absence of in situ combustion). Whether or not there is an overall change in reservoir pressure depends on a variety of factors, primarily the input and output balance of gases or fluids, the states of those fluids and the possible internal generation or transformation of fluids.

In alternative embodiments, an aqueous fluid may be injected to control the in situ combustion. In some embodiments, oil saturation in the gas zone, such as residual or connate oil, may serve as a fuel for ongoing in situ combustion. In the context of the invention, oil for combustion may be any oil that resides in the pores of the formation, which may variously be referred to residual oil, such as residual oil residing in the pores following precedent recovery processes, or connate oil that resides in the formation as the result of natural processes. Alternatively, a hydrocarbon fuel may be injected to sustain in situ combustion. In some embodiments, the natural gas zone may for example have a residual oil saturation of from about 5% to about 40% (including any value within this range). In some embodiments, the average pressure in the gas zone prior to in situ combustion may be less than about 700 kPa. In some embodiments, the average pressure in the gas zone may be elevated or controlled by the processes of the invention so that it is at least about 800 kPa.

In some embodiments, the pressuring of the gas zone may be followed by depletion of the heavy oil zone. Alternatively, depletion of the heavy oil zone may be, in whole or in part, concurrent with pressuring within the gas zone (which includes re-pressuring or maintaining pressure within the gas zone). For example, the heavy oil may be recovered by a process that comprises injecting a heated fluid into the heavy oil zone and producing hydrocarbons from the heavy oil zone that are mobilised under the influence of gravity by the heated fluid, such as SAGD.

In some embodiments, natural gas may be produced from the gas zone, for example from a production well that is spaced apart from the injection well that is used to inject the oxidising gas. Production of natural gas may for example take place during in situ combustion, or during a period when in situ combustion has been discontinued. Production of natural gas may be concurrent with production of other reservoir fluids, including the products of combustion or low temperature oxidation.

In some embodiments, the methods of the invention include the following distinctive feature, oil saturation present within the gas zone provides the fuel for the in situ combustion process. In an additional aspect, in some embodiments, in contrast to typical in situ combustion applications, the invention involves the application of in situ combustion to remove or deplete the oxygen contained in injected oxidising gases, such as air, through combustion reactions, thereby producing combustion gases that may be utilised for gas displacement of hydrocarbons ahead of the combustion front.

In some embodiments, reservoirs are selected for application of the present invention that have sufficient oil saturation in the gas zone to arrest or avoid large-scale movement of the combustion front through the reservoir. This feature may restrict the area affected by combustion reactions to a relatively small region or zone around the oxidising gas injection well, which may allow greater flexibility in producing natural gas from various production wells in the gas zone.

In some embodiments, the invention accordingly provides methods by which both the gas and oil resources in a reservoir may be produced, by the application of in situ combustion to displace natural gas from gas zone while increasing the reservoir pressure to allow subsequent extraction of the underlying heavy oil.

BRIEF DESCRIPTION OF THE FIGURES

FIG. 17. Examples of formation specifics.

FIG. 19. This is a table showing process steps.

DETAILED DESCRIPTION OF THE INVENTION

Figure 1A:
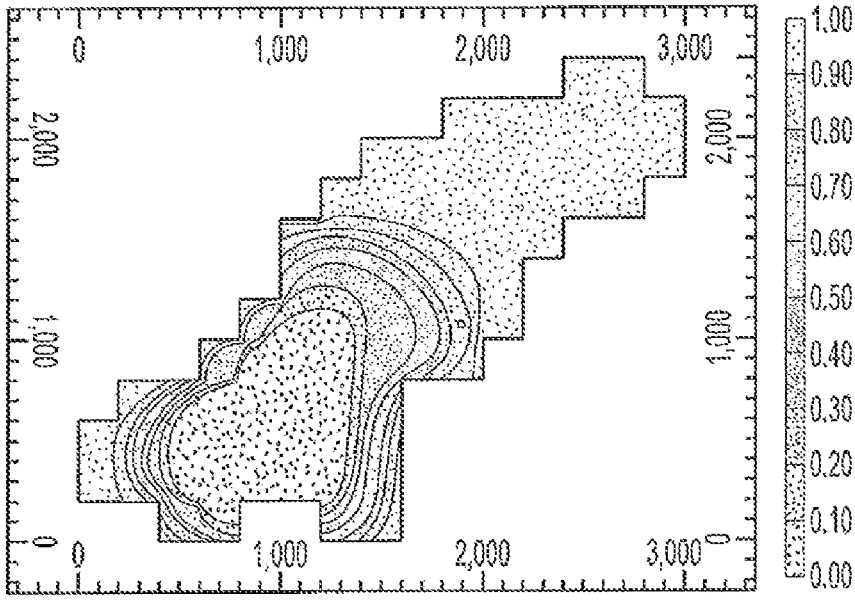
FIGS. 1A and 1B illustrate in a plan view at two different times during the in situ combustion process, the distribution of methane (natural gas) as it migrates from an injector well to one or more sets of production wells.

In oil sands, such as some of those found in Western Canada, there are natural gas reservoirs which contain a significant level of oil saturation in a gas-bearing formation overlying a bitumen-bearing formation (a "gas over bitumen" formation). In one aspect, the invention provides hydrocarbon recovery methods adapted for gas over bitumen (GOB) formations, wherein the pressure in the overlaying natural gas reservoir may be modulated to facilitate recovery of heavier hydrocarbons from the underlying formations.

In some embodiments, sufficient oil saturation in the gas-bearing formation is available as a fuel, so that in situ combustion of the oil may be used both to recover residual natural gas and to maintain the pressure or re-pressure the gas formation to facilitate recovery of heavy oil underlying the gas zone. In alternative embodiments, in the absence of significant oil saturation in the natural gas reservoir, a liquid hydrocarbon may for example be introduced as a fuel source for in situ combustion.

In various embodiments of the invention, processes involve the injection of a gas with oxidizing capability (an oxidizing gas) into a reservoir containing natural gas, through an injection well. The oxidizing gas may for example be any gas or gas mixture capable of supporting combustion, for example air.

The temperature within the reservoir in the vicinity of the injection well may be increased so as to initiate in situ combustion. This step, which is referred to as ignition, may for example be accomplished in one of a variety of ways known in the art. Continued injection of the oxidizing gas sustains the in situ combustion process, in a constant or intermittent fashion. The oxidizing gas may be injected in a controlled manner to modulate the combustion process.

Controlled in situ combustion may be implemented so that a relatively immobile liquid or semi-solid hydrocarbon within the pores of the formation serves as the combustion fuel, so that the location of the fuel and of the associated combustion front is reasonably well defined. In some gas over bitumen formations, it has been discovered that the pores of the natural gas reservoir contains a significant degree of oil saturation, in addition to natural gas and water. Such natural gas reservoirs with naturally occurring oil saturation have for example been identified in the McMurray Formation in the province of Alberta in Canada. In some embodiments, the use of this oil saturation as a combustion fuel may for example be facilitated where the natural gas reservoir contains initial oil saturation in concentrations of from about 5% to about 40%.

Should oil saturation within the natural gas reservoir be insufficient to provide fuel for a sustained in situ combustion process, a bitumen, or a blend of bitumen and lighter hydrocarbon, or other suitable selected liquid hydrocarbons, may be injected at or in the vicinity of the injection well. The bitumen, bitumen blend or liquid hydrocarbons may be injected so as to provide fuel for the in situ combustion process.

In some embodiments, for in situ combustion procedures, existing vertical wells may serve as both injection and production wells. In other embodiments, production wells may be used so as to assist in governing the progress and shape of the combustion front as it moves out from the injection well. In alternative embodiments, it may not be necessary to propagate the combustion front out to those production wells.

In various embodiments, the gases that are the product of in situ combustion flow within the natural gas reservoir, for example from the oxidizing gas injection well to a suitably placed production well, displacing the natural gas into the production well for recovery. In some embodiments, the processes of the invention may be adapted so that the gas reservoir pressures obtained by the processes of the invention fall within the range encountered within the natural gas reservoir at the outset of preliminary recovery procedures.

In alternative embodiments, oxidizing gas may be injected into the natural gas reservoir in an amount that is in excess of any gas that is produced. In situ combustion may then be initiated, and sustained so that the pressure within the natural gas reservoir is allowed to increase until it reaches a prescribed level. In such embodiments, the process of the invention is adapted so that the combustion gases repressurize the natural gas reservoir, for example to levels comparable to that of an associated underlying oil sand reservoir. This may for example facilitate the application of a recovery process within the oil sand reservoir, such as steam assisted gravity drainage.

In various embodiments, in situ combustion may be carried out so that it results in displacement of the native methane with an oxygen-depleted gas. In such embodiments, in situ combustion serves both to increase the volume of displacement gases, using in situ bitumen as fuel, while depleting the injected gas of potentially dangerous oxygen, leaving nitrogen, carbon dioxide and other combustion products as the primary constituents of the oxygen-depleted gas.

In some embodiments, dry combustion may be used as the mode of in situ combustion. In alternative embodiments, it may be advisable to control temperature within the in situ combustion zone by injecting an aqueous fluid such as water.

In some embodiments, to facilitate displacement and recovery of natural gas, it may be appropriate to control the movement of the combustion gases by means such as manipulation of outflow from the production wells or by means of an injected aqueous fluid. Channelling and premature breakthrough of the combustion gases at production wells may be controlled so as to facilitate efficient displacement and recovery of the natural gas. In some embodiments, for example to facilitate re-pressurization of a natural gas reservoir, there may be no need for low pressure natural gas displacement and recovery.

When in situ combustion is applied in an environment where the predominant hydrocarbon saturation is an oil that contains a significant content of very viscous components, there may be a risk that the in-situ combustion process may lead to plugging of pores, with resulting adverse consequences for injectivity at the injection well. Where the predominant constituent of the hydrocarbon reservoir is natural gas, with a relatively low level of viscous oil saturation, injectivity problems are less likely to occur. Processes of the invention may therefore involve initiating an in situ combustion zone based upon the degree to which the zone is saturated with a viscous hydrocarbon.

In some fields, existing wells may be utilized for processes of the invention. However, additional wells or alternate wells, or both, may of course be provided.

In some embodiments, injection and production wells may be vertical. Wells having trajectories within the reservoir that deviate substantially from vertical may also be employed, including for example horizontal wells.

For a number of exemplary embodiments, the parameters of the in situ combustion processes of the invention have been modelled, and various modelled interaction between injected air, combustion gases and hydrocarbons within a reservoir are described in the Figures. An example of formation parameters is illustrated in FIG. 17.

Figure 1B:
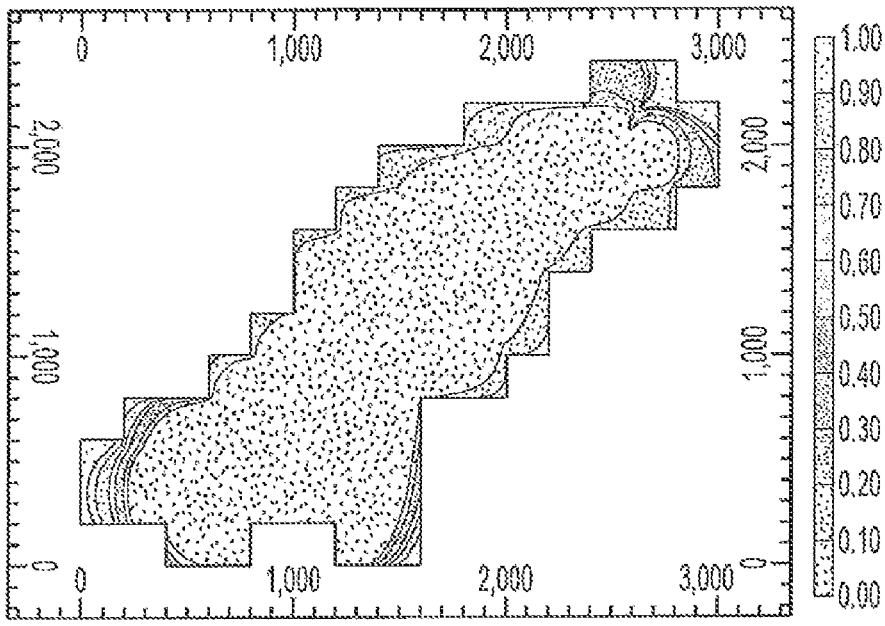
Figure 2A:
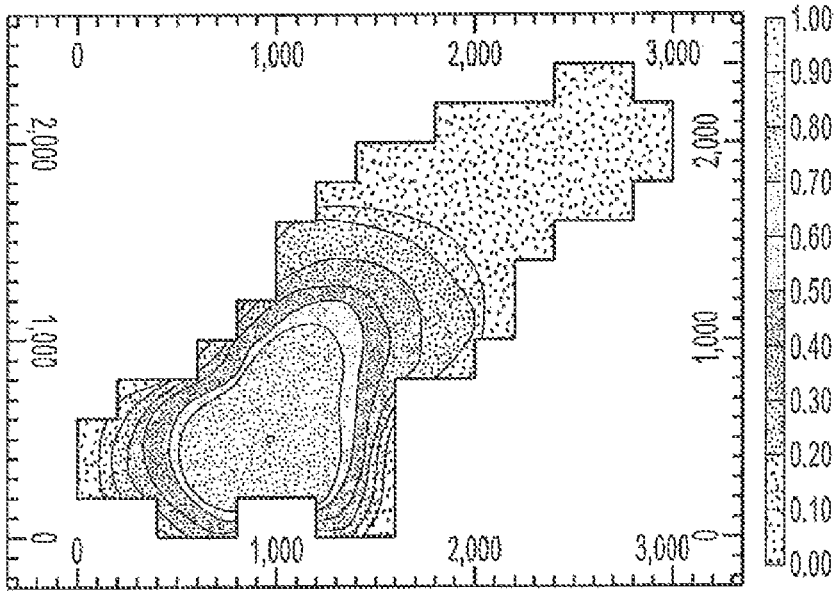
FIGS. 2A and 2B illustrate in a plan view at two different times during the in situ combustion process, the distribution of nitrogen during and after air injection and in situ combustion from an injector well to one or more sets of production wells.
Figure 2B:
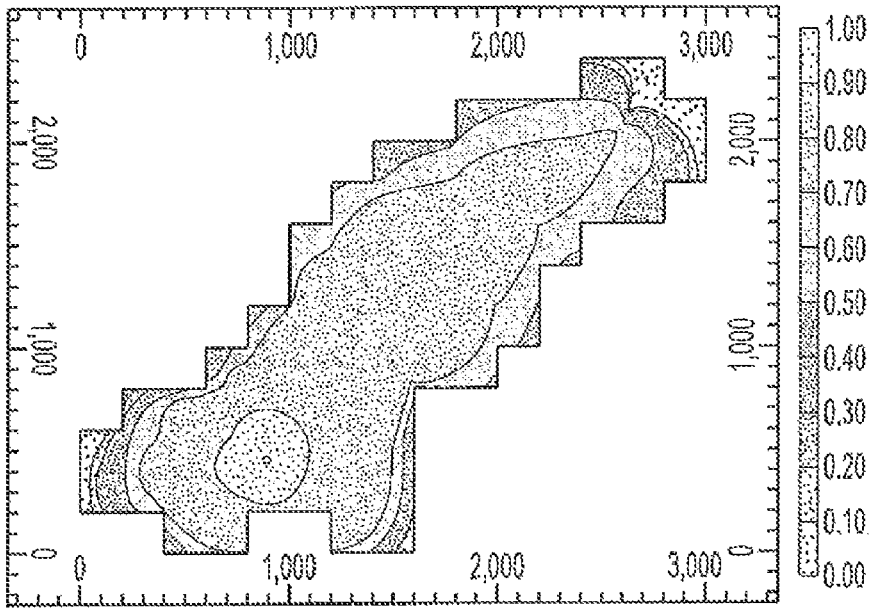
Figure 5A:
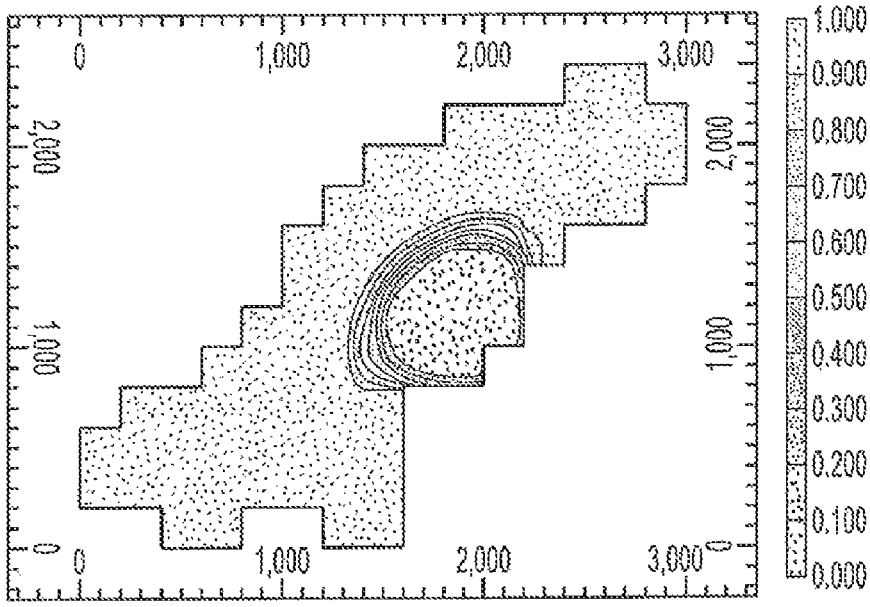
FIGS. 5A and 5B illustrate in a plan view at two different times during the in situ combustion process when excess injection gas is provided, the distribution of methane (natural gas) as it migrates from an injector well to one or more sets of production wells.
Figure 5B:
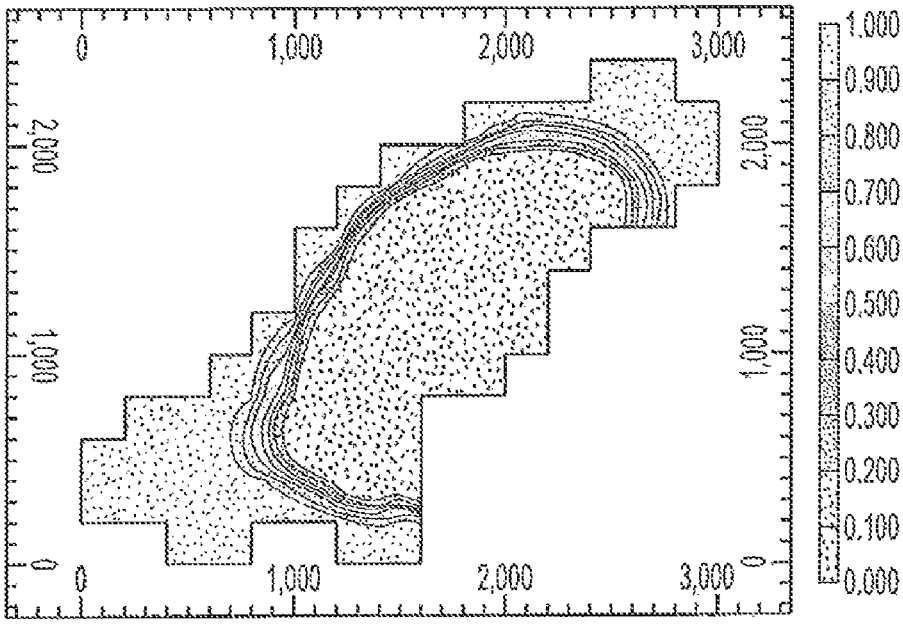
Figure 6A:
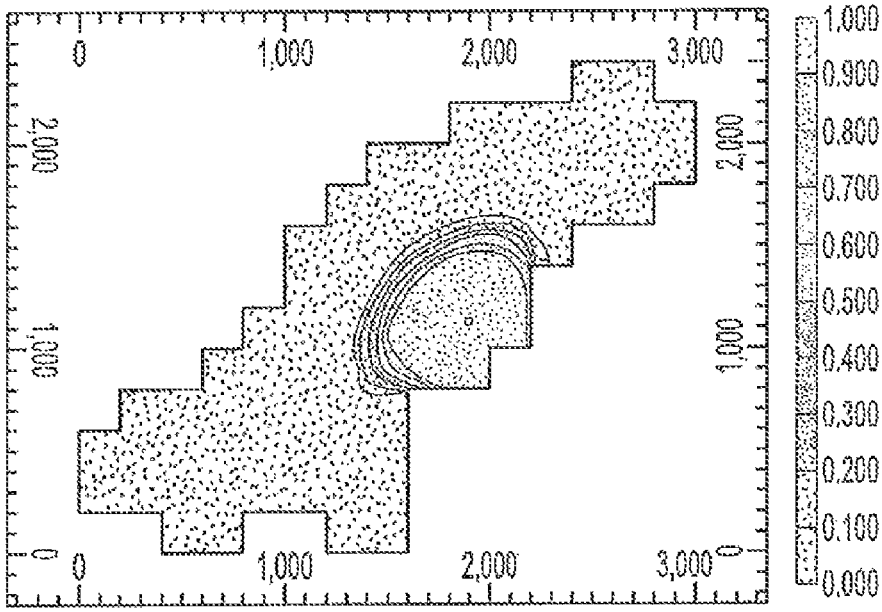
FIGS. 6A and 6B illustrate in a plan view at two different times during the in situ combustion process when excess injection gas is provided, the distribution of nitrogen during and after air injection and in situ combustion from an injector well to one or more sets of production wells.
Figure 6B:
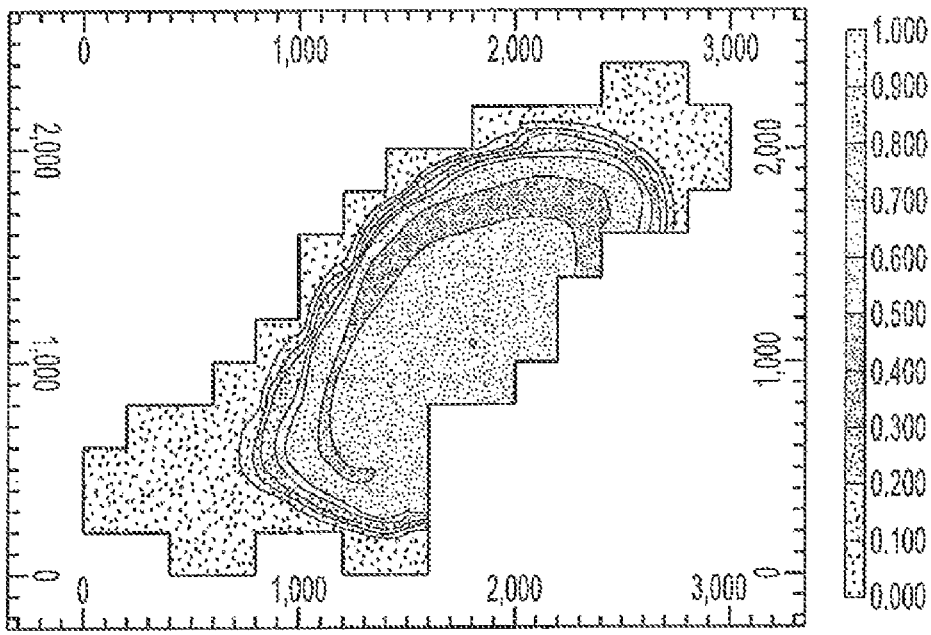
Figure 10:
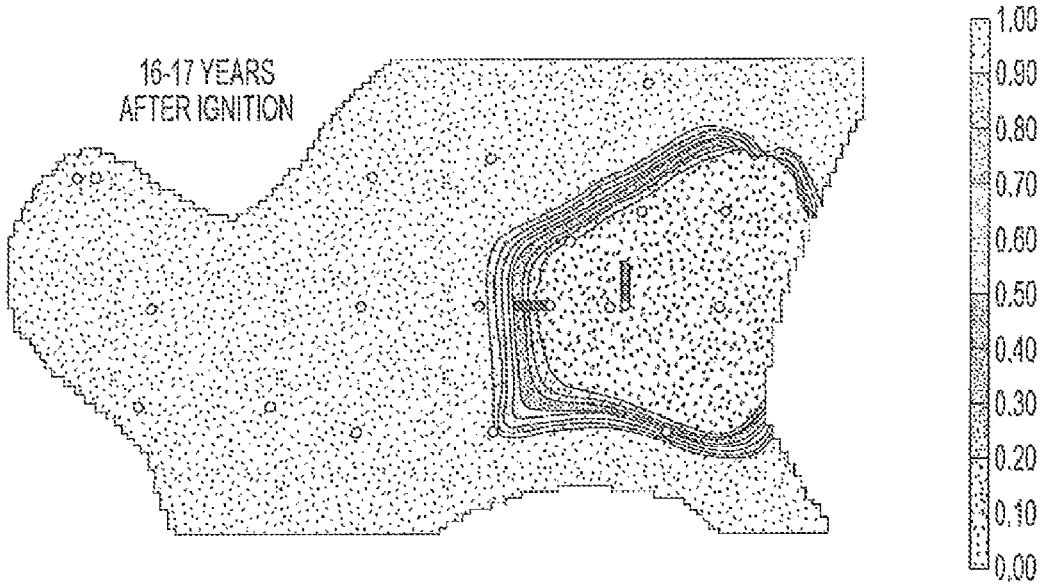
FIG. 10. Representation of methane profile in late stages, 16 to 17 years after ignition.

As illustrated in FIGS. 1A and 1B and in FIGS. 5A and 5B, during in situ combustion, the methane (natural gas) may be driven from the region around the injection well to gas production wells, for example until the last producible well is reached. The methane profile 16 to 17 years after ignition is shown in FIG. 10.

Figure 9:
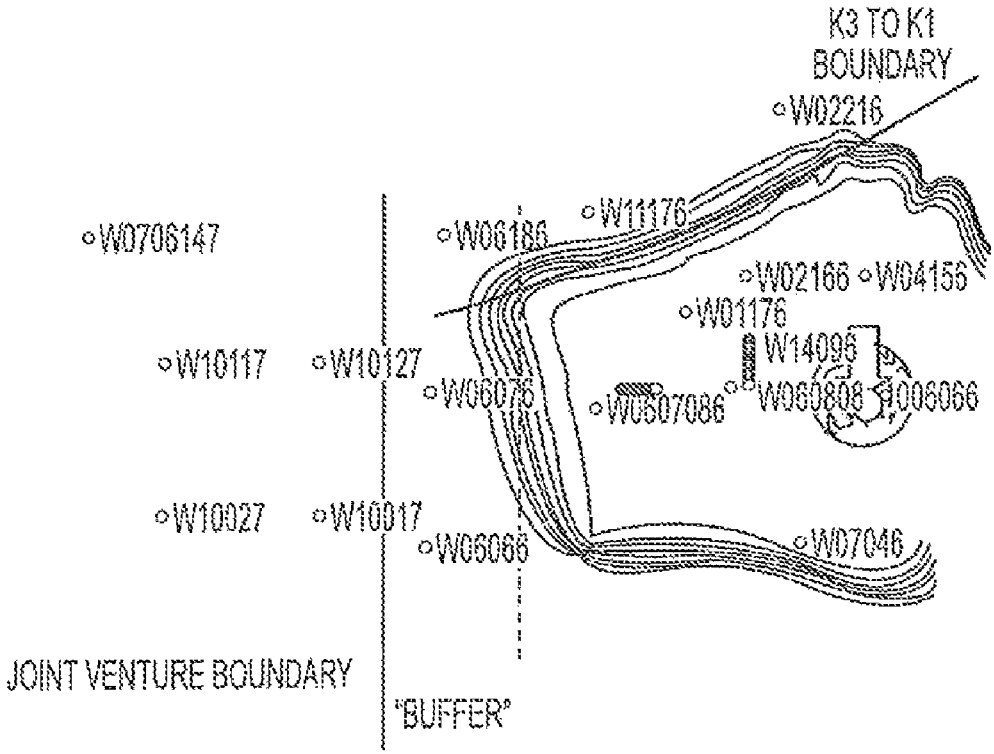
FIG. 9. Representation of nitrogen profile in late stages 16 to 17 years after ignition.
Figure 16:
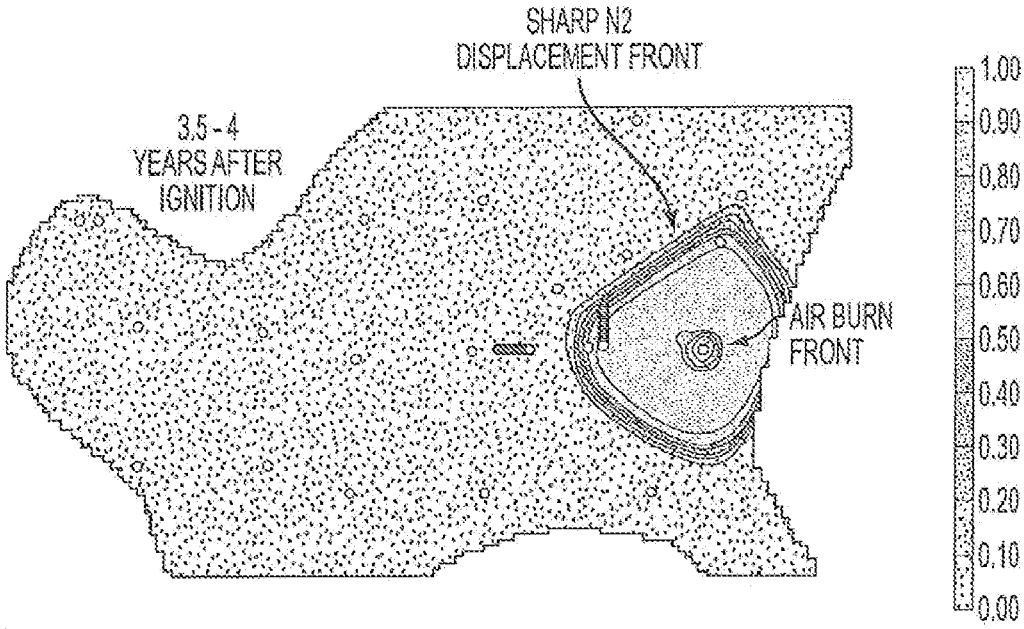
FIG. 16. Nitrogen profile in early stages.

Model nitrogen distribution profiles are shown in FIGS. 2A and 2B, FIGS. 6A and 6B, in FIG. 9 and in FIG. 16, illustrating that processes of the invention may be adapted so that nitrogen occupies a very wide region of the natural gas reservoir. The relative inertness of nitrogen, in contrast to the comparatively high reactivity of oxygen, may result in a preferential filtering out of the oxygen, through reactions during in situ combustion.

In some embodiments, methane production at offset gas production wells may be continued until nitrogen breakthrough at the production well. Production wells may be shut-in once nitrogen (or another combustion gas) reaches an unacceptable limit. In such circumstances, methane gas production may be continued at other wells, until they too are shut-in following combustion gas (such as nitrogen) breakthrough. In some embodiments, gas displacement by in situ combustion may thereby be continued to maximise methane gas production using a succession of production wells.

Figure 3A:
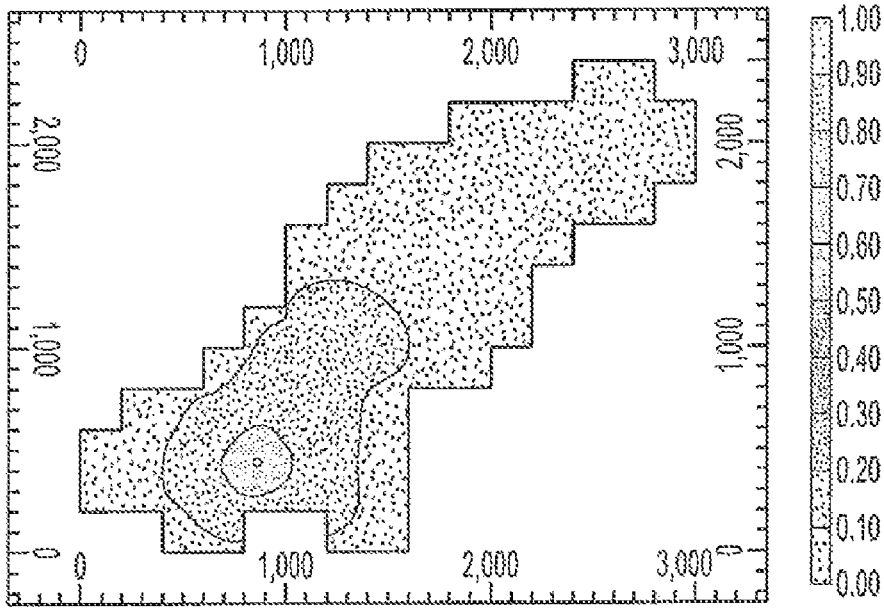
FIGS. 3A and 3B illustrate in a plan view at two different times during the in situ combustion process, the distribution of oxygen as it is consumed during combustion.
Figure 3B:
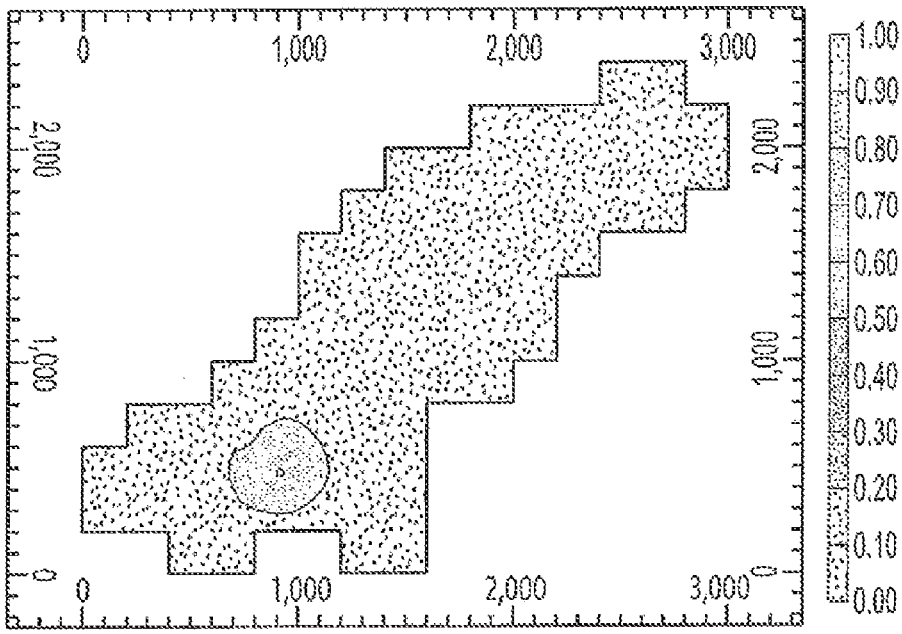
Figure 7A:
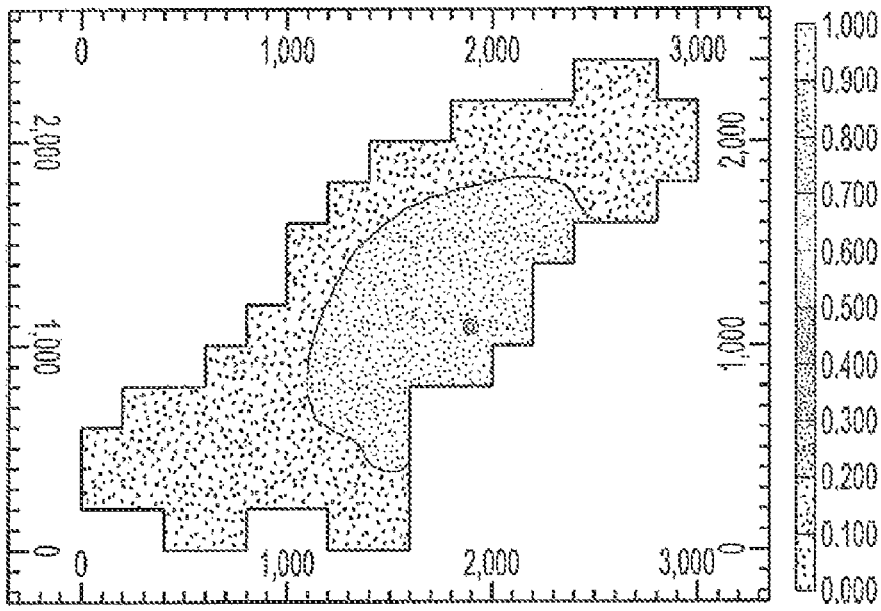
FIGS. 7A and 7B illustrate in a plan view at two different times during the in situ combustion process when excess injection gas is provided, the distribution of oxygen as it is consumed during combustion.
Figure 7B:
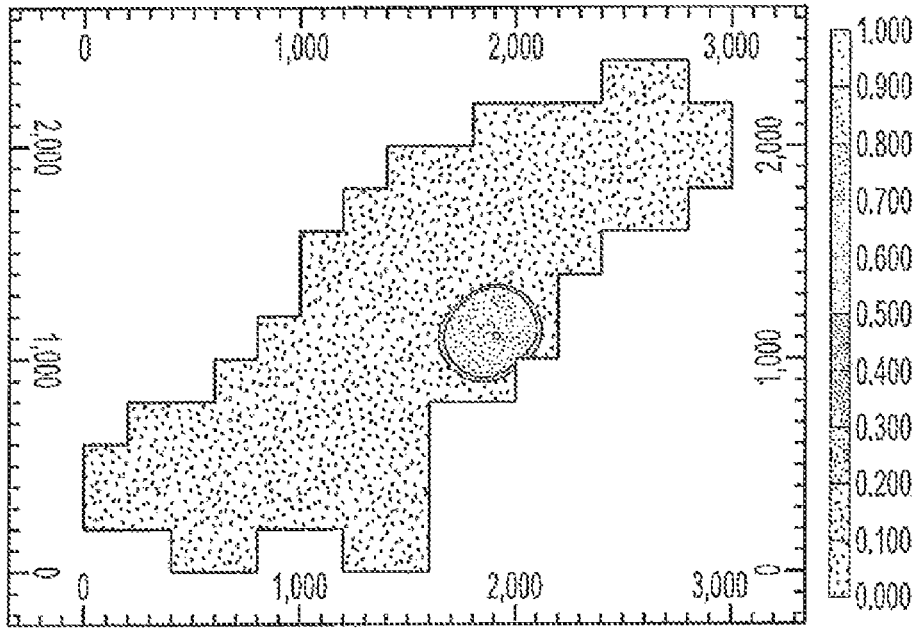
Figure 11:
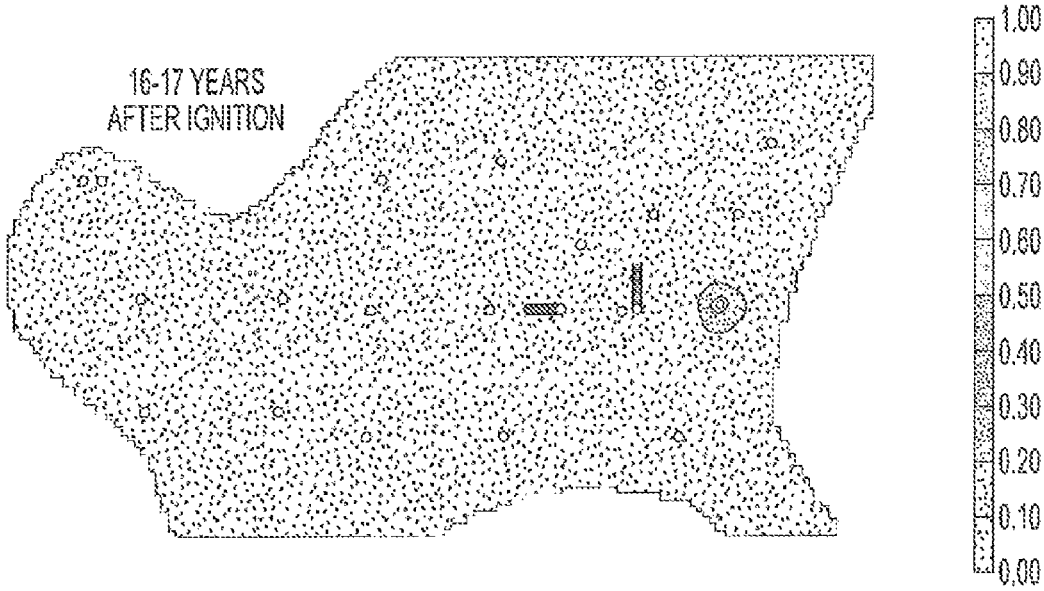
FIG. 11. Representation of oxygen profile in late stages.

The modelled net effect of filtering out oxygen through the combustion process is illustrated in FIGS. 3A and 3B and in FIGS. 7A and 7B. In these representations, some oxygen moves beyond the combustion front. However, with time, even this oxygen may be consumed, for example in low temperature chemical reactions within the reservoir. The oxygen profile 16 to 17 years after ignition is shown in FIG. 11.

Figure 4A:
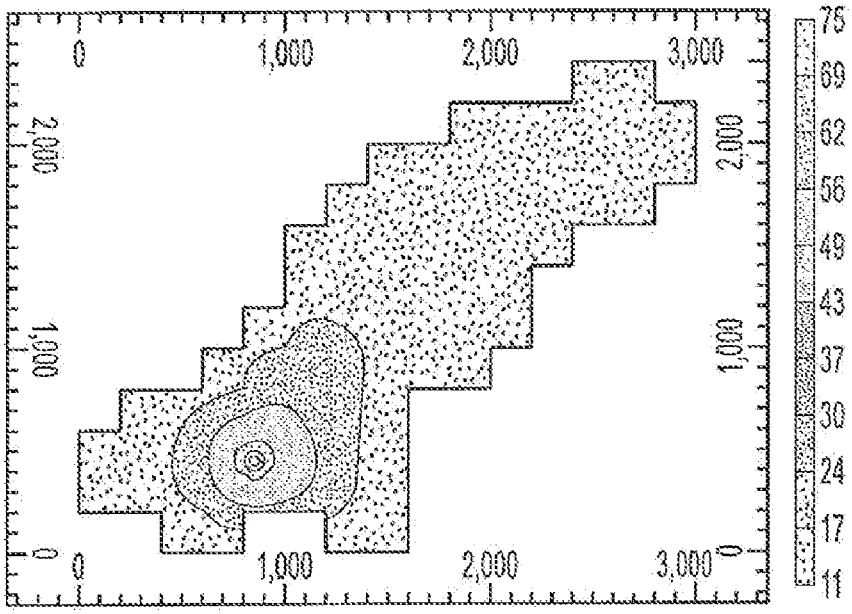
FIGS. 4A and 4B illustrate in a plan view at two different times during the in situ combustion process, the reservoir temperature profile during and after air injection and in situ combustion from an injector well to one or more sets of production wells.
Figure 4B:
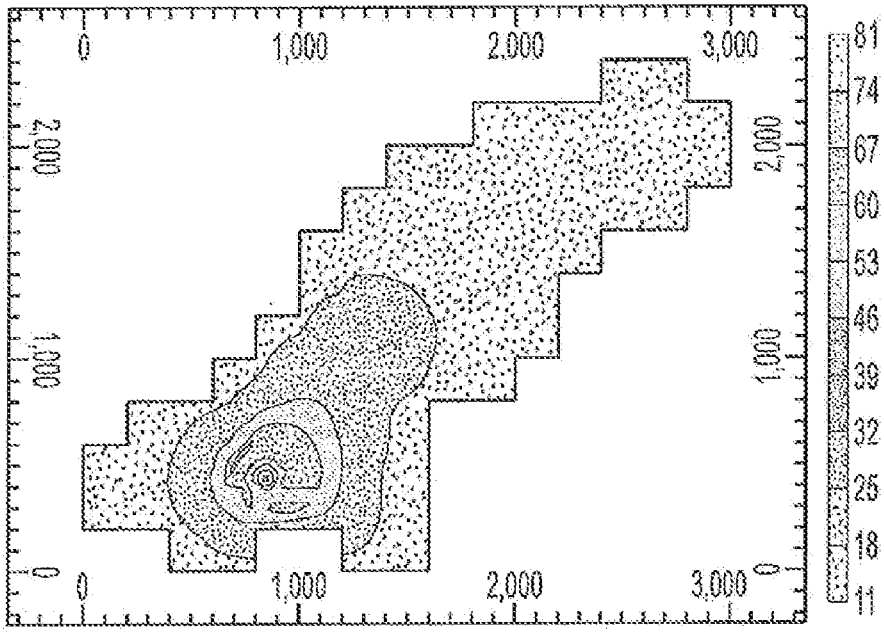
Figure 8A:
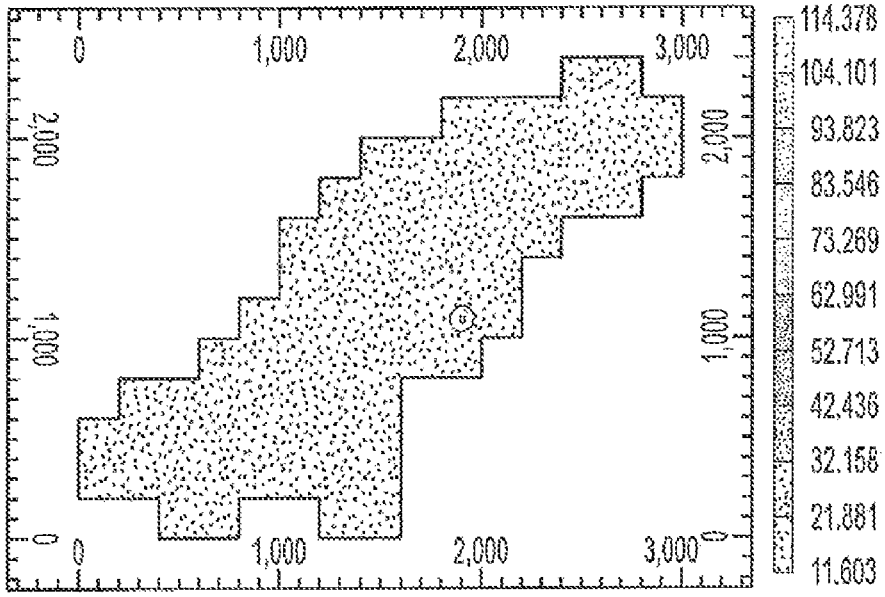
FIGS. 8A and 8B illustrate in a plan view at two different times during the in situ combustion process when excess injection gas is provided, the reservoir temperature profile during and after air injection and in situ combustion from an injector well to one or more sets of production wells.
Figure 8B:
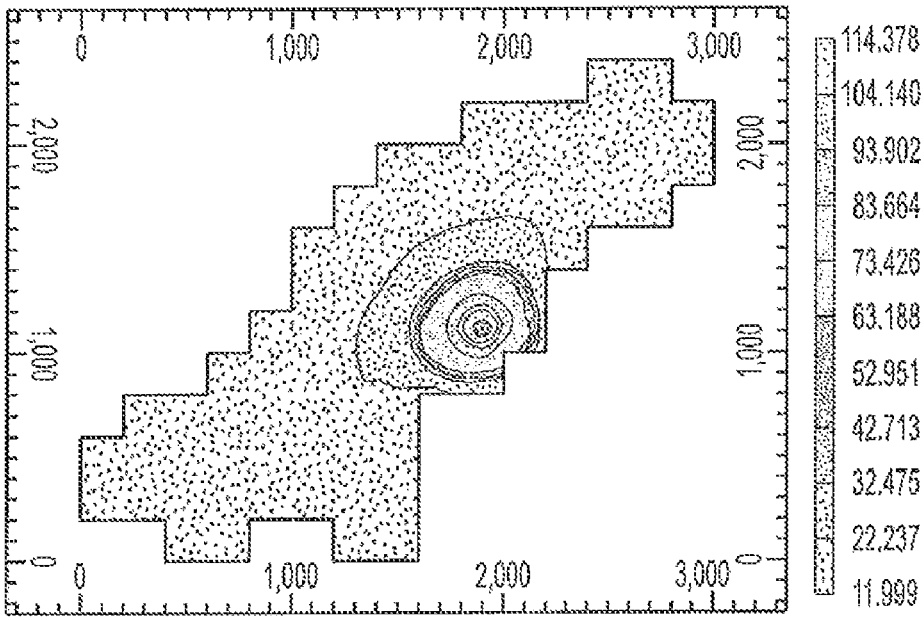

Modelled temperature distribution profiles are shown in FIGS. 4A and 4B and in FIGS. 8A and 8B. Each illustration is a plan view at two different times during the in situ combustion process. Shown are the temperature distribution resulting from both the initial heating to prepare the near-well region for ignition, and the temperature changes due to oxidation reactions. In some embodiments, the extent of the high temperature combustion zone may be limited to the region around the injection well, for example by modulating the amount and rate of oxidizing gas injection, and the outflow from the production wells, and, in some embodiments, also because it is held up by the oil saturation which is not displaced to production wells far removed from the oxidizing gas injection well.

In some embodiments, production wells may be shut in so that the formation pressure is maintained at a desired value. The progression of the combustion front and modulation of the in situ combustion process may for example be monitored by measuring LEL, oxygen and nitrogen levels in the producers near injector wells. Temperature may for example be monitored by SCADA meter.

Figure 18:
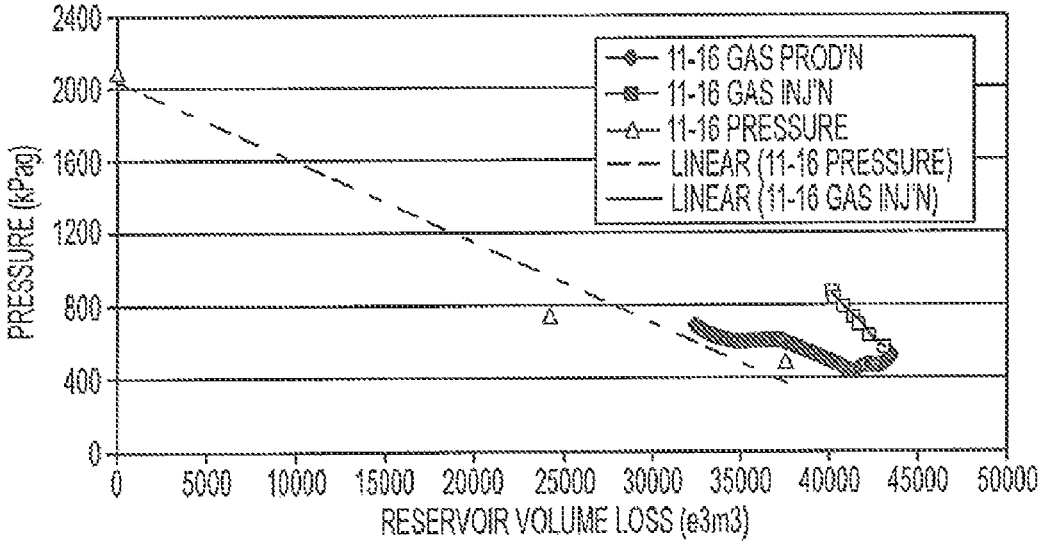
FIG. 18. Gas zone pressure as a function of gas reservoir volume loss.

In some embodiments, the processes of the invention provide the flexibility to repressure a depleted gas zone to a desired pressure, such as a pressure that is appropriate for recovery processes to be applied to the underlying heavy oil or bitumen reservoir. This may for example be accomplished by continuing injection of oxidizing gas to promote or sustain the in situ combustion reactions while shutting in production wells, as illustrated in FIG. 18. In some embodiments, natural gas production from the last production well may be completed, for example when the mole fraction of methane reaches a production cut off threshold, and in situ combustion may be continued until the desired reservoir pressure is reached. An example of the process steps that may be utilized is shown in FIG. 19.

Figure 12:
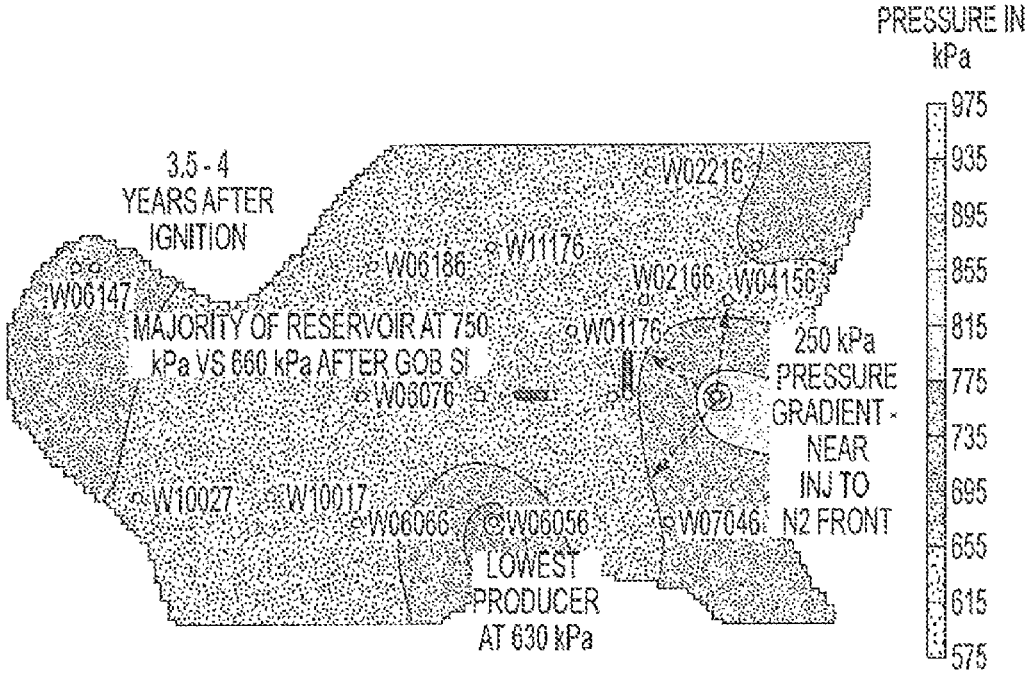
FIG. 12. Pressure profile during early injection.
Figure 13:
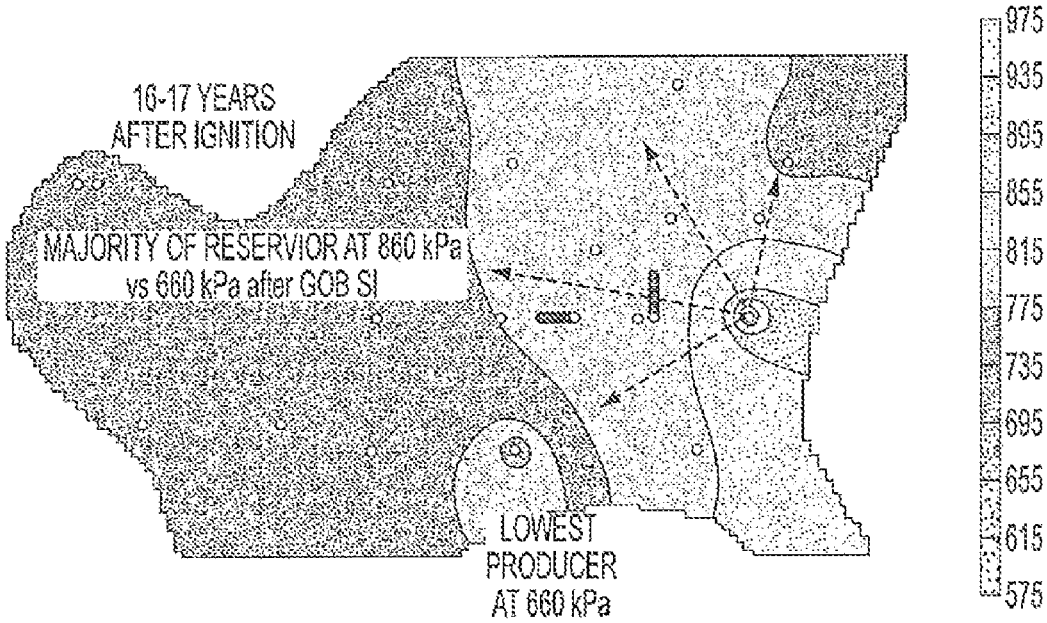
FIG. 13. Pressure profile during late injection.
Figure 14:
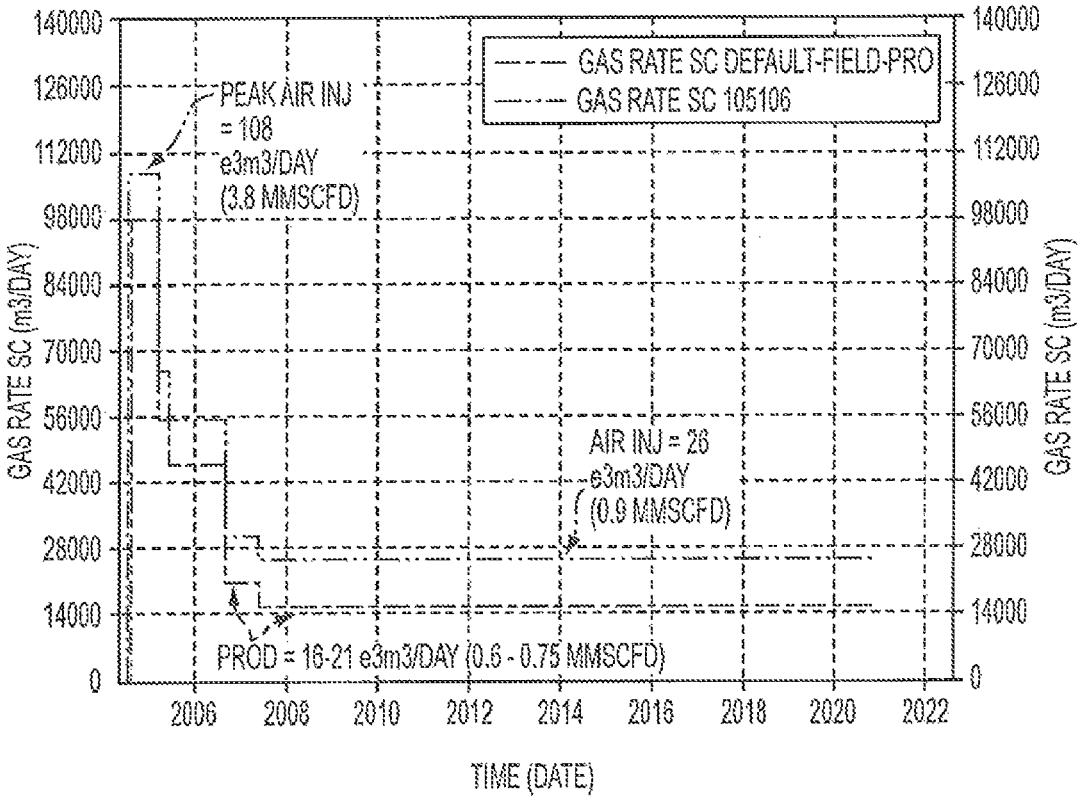
FIG. 14. Field gas injection/production forecast.
Figure 15:
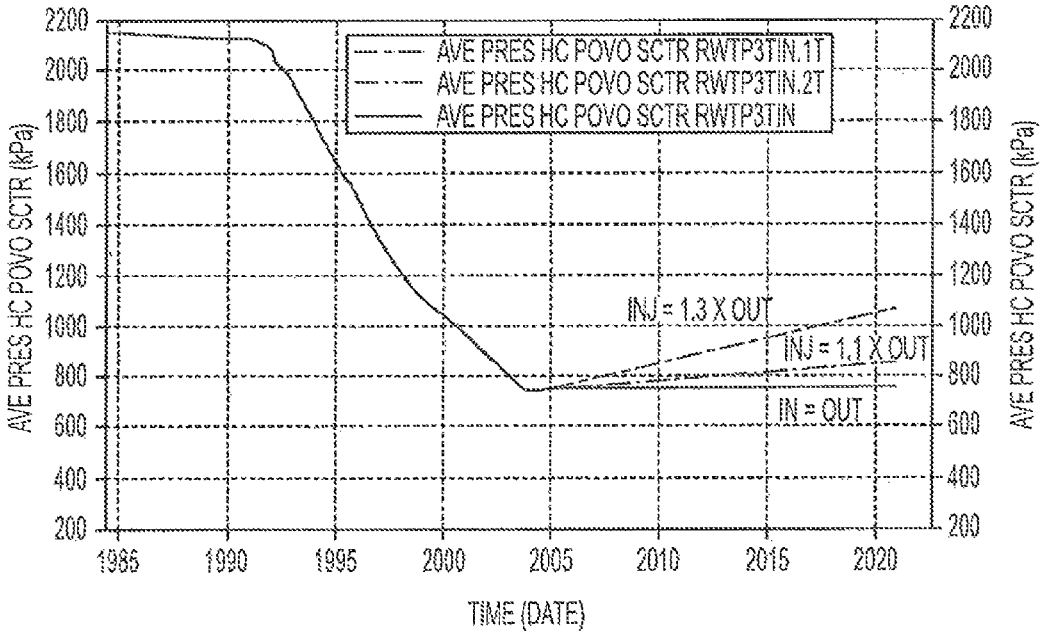
FIG. 15. Average Reservoir pressure.

A decision on the degree of pressuring (including the degree of re-pressuring or the degree of pressure maintenance) to be implemented, in a reservoir, such as a gas over bitumen reservoir, will depend upon the pressure conditions desired for subsequent or concurrent depletion of the heavy oil, for example pressure suited for implementation of a recovery technique such as SAGD. Thus, for example, in the case of a partially depleted gas zone which overlies bitumen in the McMurray Formation of Alberta, Canada, its pressure may be 400 to 800 kPa. An oxidizing gas may be injected into the gas zone to maintain this pressure level or to increase it to a level close to or at the original formation pressure, for example 2500 kPa, or to some intermediate pressure level as illustrated in FIG. 14 (being, for example, any integer value between 400 and 2500). Alternatively, one may intentionally re-pressure the gas zone to levels in excess of the original formation pressure. Example pressure profiles during early and late injection are shown in FIGS. 12 and 13, respectively. FIG. 15 illustrates the average reservoir period over a 40 year period.

In some embodiments, a "water kill" system may be used to control injector burnback. In further alternative embodiments, automated ESD of high oxygen producers and/or production and injection balancing within a range of +/−10% RGIP may be used to monitor and modulate the in situ combustion process.

In some embodiments ignition may be accomplished with, for example, a down-hole gas burner. In further alternative embodiments, the process may include, for example, a stepwise increase in air injection rate. In some embodiments, monitoring may be conducted to, for example, sample gas for products of oxidation at two wells, assess temperature by measurements at several wells including the air injector, and to measure reservoir pressure at two wells.

In some embodiments where the gas field overlying the heavy oil reservoir is extensive, gas displacement and repressuring may be accomplished by use of more than one oxidising gas injection well located at spaced apart locations. The positions of the injection wells may be selected to be consistent with producing natural gas from various production wells, for example until produced gas contaminant composition reaches a specified limit. Shut in of production wells once that limit is reached may be followed by subsequent increase in reservoir pressure by continued injection of oxidising gas to sustain in situ combustion.

The invention claimed is:

1. A method of producing natural gas, comprising:

injecting an oxidizing gas, without injecting water or steam, into a natural gas zone of a hydrocarbon reservoir, wherein the natural gas zone is in pressure communication with an underlying heavy oil zone and the injecting is carried out via an injection well;

sustaining in situ combustion in the natural gas zone with the oxidizing gas so as to control average reservoir pressure;

producing natural gas from the natural gas zone, wherein initial oil saturation in the natural gas zone fuels in situ combustion and has an initial oil saturation above 5%; and depleting the underlying heavy oil zone by a heavy oil recovery process.

2. The method of claim 1, wherein the heavy oil zone has heavy oil saturation of at least 50%.

3. The method of claim 2, wherein the average pressure in the natural gas zone prior to in situ combustion is less that about 700 kPa.

4. The method of claim 1, wherein controlling the average reservoir pressure comprises controlling the average pressure in the natural gas zone so that it is at least about 800 kPa.

5. The method of claim 1, wherein the oxidizing gas is air.

6. The method of claim 5, wherein the gas zone and the heavy oil zone are in pressure communication through a water zone.

7. The method of claim 1, wherein the reservoir pressure is maintained at a constant level while producing natural gas from the natural gas zone.

8. The method of claim 7, wherein the natural gas is produced concurrently with air injection and in situ combustion until gas composition in the produced gas reaches contaminant levels above a specified limit.

9. The method of claim 1, wherein the reservoir pressure is increased while producing natural gas from the natural gas zone.

10. The method of claim 1, wherein the heavy oil recovery process comprises producing hydrocarbons from the heavy oil zone wherein the hydrocarbons are mobilized under the influence of gravity.

11. The method of claim 1, wherein the heavy oil recovery process is steam assisted gravity drainage.

12. A method of producing natural gas, comprising:

injecting an oxidizing gas, without injecting water or steam, into a natural gas zone of a hydrocarbon reservoir, wherein the natural gas zone is in pressure communication with an underlying heavy oil zone and the injecting is carried out via an injection well;

sustaining in situ combustion in the natural gas zone with the oxidizing gas so as to control average reservoir pressure;

producing natural gas from the natural gas zone, wherein initial oil saturation in the natural gas zone fuels in situ combustion and has an initial oil saturation above 5%; and depleting the underlying heavy oil zone by a heavy oil recovery process that comprises injecting a heated fluid into the heavy oil zone and producing hydrocarbons from the heavy oil zone wherein the hydrocarbons are mobilized under the influence of gravity by the heated fluid.

13. The method of claim 12, wherein the heavy oil recovery process comprises a thermal oil recovery process.

14. The method of claim 13, wherein the thermal oil recovery process comprises injecting a heated fluid into the heavy oil zone.

15. The method of claim 14, wherein the heavy oil recovery process comprises producing hydrocarbons from the heavy oil zone wherein the hydrocarbons are mobilized under the influence of gravity.

16. The method of claim 13, wherein the heavy oil recovery process comprises producing hydrocarbons from the heavy oil zone wherein the hydrocarbons are mobilized under the influence of gravity.

17. A method of producing natural gas, comprising:

injecting an oxidizing gas, without injecting water or steam, into a natural gas zone of a hydrocarbon reservoir, wherein the natural gas zone is in pressure communication with an underlying heavy oil zone and the injecting is carried out via an injection well;

sustaining in situ combustion in the natural gas zone with the oxidizing gas so as to control average reservoir pressure; and producing natural gas from the natural gas zone, wherein initial oil saturation in the natural gas zone fuels in situ combustion and has an initial oil saturation above 5%;

wherein the heavy oil zone has heavy oil saturation of at least 50%;

wherein the average pressure in the natural gas zone prior to in situ combustion is less that about 700 kPa;

wherein the gas zone and the heavy oil zone are in pressure communication through a water zone.

* * * * *